US012565783B2

(12) United States Patent
Xu et al.

(10) Patent No.: US 12,565,783 B2
(45) Date of Patent: Mar. 3, 2026

(54) REINFORCEMENT DEVICE FOR CORRECTING THE ALIGNMENT OF WOK EAR RAMMED EARTH WALLS

(71) Applicant: Shanghai Jianwei Cultural Heritage Conservation Tech. Co., Ltd., Shanghai (CN)

(72) Inventors: Songfeng Xu, Shanghai (CN); Liang Zhou, Shanghai (CN); Yong Cao, Shanghai (CN); Quan Gan, Shanghai (CN); Peng Zhang, Shanghai (CN); Qing Xu, Shanghai (CN)

(73) Assignee: Shanghai Jianwei Cultural Heritage Conservation Tech. Co., Ltd., Shanghai (CN)

( * ) Notice: Subject to any disclaimer, the term of this patent is extended or adjusted under 35 U.S.C. 154(b) by 64 days.

(21) Appl. No.: 18/681,064

(22) PCT Filed: Jul. 29, 2022

(86) PCT No.: PCT/CN2022/108972
§ 371 (c)(1),
(2) Date: Feb. 4, 2024

(87) PCT Pub. No.: WO2023/035804
PCT Pub. Date: Mar. 16, 2023

(65) Prior Publication Data

US 2024/0368908 A1 Nov. 7, 2024

(30) Foreign Application Priority Data

Sep. 10, 2021 (CN) ..... 202111061226.9

(51) Int. Cl.
*E04G 23/02* (2006.01)

(52) U.S. Cl.
CPC ..... *E04G 23/0233* (2013.01); *E04G 23/0281* (2013.01)

(58) Field of Classification Search
CPC ..... E04G 23/0218; E04G 23/0222; E04G 23/0233; E04G 23/0281
(Continued)

(56) References Cited

U.S. PATENT DOCUMENTS 2,400,852 A * 5/1946 Stevenson ..... E04G 17/12 249/21
4,706,428 A 11/1987 McCoy
(Continued)

FOREIGN PATENT DOCUMENTS

CN 102936966 A 2/2013
CN 102943572 A 2/2013
(Continued)

*Primary Examiner* — Nahida Sultana

(57) ABSTRACT

A reinforcement device for correcting alignment of a wok ear rammed earth wall includes: a wok ear reinforcing structure including a strip-shaped fixing plate, of which side fixing plates are spaced apart on each of both sides, and an end of each of the side fixing plates is provided with a first connecting ring; a rammed earth wall reinforcing structure including triangular fixing frames, side leg support columns, and a main support column. The triangular fixing frames on both sides of the wok ear respectively extend to form L-shaped connecting bars symmetric to each other, the ends are correspondingly welded together to form a surrounding integral structure. A second connecting rings and the first connecting rings are welded by rigid connecting plates. The original appearance of the wok ear rammed earth wall can be ensured with less destruction, improvements of structural strength, stability, and anti-falling ability.

7 Claims, 13 Drawing Sheets

(58) Field of Classification Search
USPC ..... 264/33, 35; 249/33, 44
See application file for complete search history.

(56) References Cited

U.S. PATENT DOCUMENTS

| | | | | |
|---|---|---|---|---|
| 6,908,263 | B1 * | 6/2005 | Ruel | E02D 29/025 405/262 |
| 7,033,116 | B1 * | 4/2006 | Ward | E04B 2/84 52/293.3 |
| 2010/0176525 | A1 * | 7/2010 | Krayenhoff | E04B 2/84 249/44 |

FOREIGN PATENT DOCUMENTS

| | | | |
|---|---|---|---|
| CN | 105275222 | A | 1/2016 |
| CN | 106703434 | A | 5/2017 |
| CN | 107869256 | A | 4/2018 |
| CN | 109281487 | A | 1/2019 |
| CN | 110685451 | A | 1/2020 |
| CN | 210622376 | U | 5/2020 |
| CN | 211818225 | U | 10/2020 |
| CN | 212359203 | U | 1/2021 |
| CN | 112443172 | A | 3/2021 |
| CN | 113006514 | A | 6/2021 |
| CN | 113833297 | A | 12/2021 |
| EP | 2597202 | A1 | 5/2013 |

* cited by examiner

REINFORCEMENT DEVICE FOR CORRECTING THE ALIGNMENT OF WOK EAR RAMMED EARTH WALLS

CROSS-REFERENCE TO RELATED APPLICATION

This application claims the priority benefits of PCT application No. PCT/CN2022/108972, filed on Jul. 29, 2022, and China application No. 202111061226.9, filed on Sep. 10, 2021. The entirety of each of the above-mentioned patent applications is hereby incorporated by reference herein and made a part of this specification.

BACKGROUND OF THE INVENTION

Field of the Invention

The disclosure relates to the technology field of architectural correction, particularly to a reinforcement device for correcting the alignment of a wok ear rammed earth wall.

Description of the Related Art

The wok is a large iron pot in ancient times. The wok ears are shaped like official hats of the Ming Dynasty. The wok-eared house is named after its tiled roof built on the ridge of the dragon boat and wok ears built on the top of the gable to block wind and fire. If you are rich, you will have a wok-eared house. The numerous wok-eared houses are the characteristics of traditional dwellings in Lingnan. Some cooperative projects adopt the wok-eared building gables, which mean "to be the best". The wok ear wall is the important symbol of Lingnan architecture. The wok-eared houses are only built in Lingnan.

The wok-ear mud wall belongs to the early form of Lingnan architecture. It is built using traditional rammed earth technology. The roofing is made of bricks, which are generally thicker than 420 mm. The thickness of the brick reaches 720 mm. Since the partial rammed earth wall has a higher height and there are many typhoons and rains in Lingnan, the earth walls experience issues such as erosion, scouring, outward displacement, cracking, and other damages.

In the existing technology, rammed earth walls are mostly reinforced by building scaffolding, grouting and other operations. However, the technology does not achieve very high reinforcement strength and overall reinforcement effect. It only repairs and reinforces some local locations of the wall. The reinforcement treats the symptoms but not the root cause. Especially in the case of earthquakes, typhoons, and rain erosion, it often has little effect. For the reinforcement and repair of rammed earth walls that need to keep their overall shape unchanged, it is necessary to provide a new type of reinforcing structure and device with practical effects. Therefore, the disclosure provides a reinforcement device for correcting the alignment of a wok ear rammed earth wall which is of great significance.

SUMMARY OF THE INVENTION

The disclosure provides a reinforcement device for correcting the alignment of a wok ear rammed earth wall to overcome the foregoing problems.

In order to solve the foregoing technical problems, the disclosure is achieved through the following technical solutions:

The disclosure provides a reinforcement device for correcting the alignment of a wok ear rammed earth wall, which includes:

a wok ear reinforcing structure including a strip-shaped fixing plate on the upper surface of a wok ear, the overall shape of the strip-shaped fixing plate consists with the trending path of the wok ear after being pressed down, several side fixing plates are spaced apart on each of both sides of the strip-shaped fixing plate, and an end of each of the side fixing plates is provided with a first connecting ring; and a rammed earth wall reinforcing structure including triangular fixing frames on both sides of the wok ear, two side leg support columns on the bottom of each of the triangular fixing frames, and a main support column between the two side leg support columns, the triangular fixing frames on both sides of the wok ear respectively extend to form "L"-shaped connecting bars symmetric to each other, ends of the "L"-shaped connecting bars are correspondingly welded together to form a surrounding integral structure, two waist sides of the triangular fixing frame are provided with second connecting rings spaced apart to correspond to the first connecting rings, the number of the second connecting rings is equal to that of the first connecting rings, and the second connecting rings and the first connecting rings are welded by rigid connecting plates.

Further, the strip-shaped fixing plate and the side fixing plates are arranged within grooves formed on the surface of the wok ear. The side fixing plates are located on both sides of the wok ear and are arranged within gaps between adjacent pairs of decorative protrusions on radial protrusions. At least one of the side fixing plates is arranged between adjacent two of the decorative protrusions.

Further, the side fixing plate has a semi-convex shape that consists with the outer contour of the radial protrusion.

Further, the strip-shaped fixing plate and the side fixing plates are rigid fixing plates and their thickness is consistent with the depth of the grooves formed on the wok ear.

Further, the triangular fixing frames, the "L"-shaped connecting bars, the side leg support columns, and the main support column are all snugly fitted against the surface of a rammed earth wall and are arranged within grooves formed on the outer surface of the rammed earth wall. The thickness of each of the triangular fixing frame, the "L"-shaped connecting bar, the side leg support column, and the main support column is equal to the depth of the corresponding groove.

Further, the bottom of each of the side leg support column and the main support column is provided with a support block (201) and the surface of the support block (201) is provided with a bolt hole fixed with a grounding bolt.

Further, grooves formed the outer surfaces of both the wok ear and the rammed earth wall are filled and coated with glutinous rice and mortar to form a mud layer and the material and color of the mud layer respectively match the material and color of the surface of a wok ear rammed earth wall.

Compared with the existing technology, the disclosure has the following beneficial effects:

The disclosure provides a wok ear reinforcing structure and a rammed earth wall reinforcing structure. The wok ear reinforcing structure is composed of a strip-shaped fixing plate and side fixing plates on both sides of the strip-shaped fixing plate. The rammed earth wall reinforcing structure is composed of triangular fixing frames, "L"-shaped connecting bars on both sides of the triangular fixing frame, a main support column, and side leg support columns. The structure is implemented with an assembled structure, which can be designed and customized separately based on the shapes and sizes of different wok ear rammed earth walls and assembled on site. It has the advantages of convenient transportation and simple use and installation.

The structure of the disclosure forms grooves on the surface of the wok ear rammed earth wall and pre-embeds components into the grooves to fix and install the overall frame. After the installation is completed, the grooves formed on outer surfaces of both the wok ear and the rammed earth wall are filled and coated with glutinous rice and mortar to form a mud layer. The material and color of the mud layer respectively match the material and color of the surface of a wok ear rammed earth wall, thereby ensuring the original appearance of the wok ear rammed earth wall. The structure of the disclosure is less destructive and greatly used to enhance the structural strength.

The structure of the disclosure is exquisitely designed. It can correct and protect the wok ear structure and place it tilted, such that the wok ear and the rammed earth wall are integrally formed and the overall building structure is fixed with the ground to form one, thereby ensuring the strength of the structure and greatly improving the stability and anti-falling ability of the building structure.

Certainly, any product implementing the disclosure does not necessarily need to achieve all the foregoing advantages simultaneously.

BRIEF DESCRIPTION OF THE DRAWINGS

In order to explain the technical solutions of the embodiments of the disclosure more clearly, the drawings needed to describe the embodiments will be briefly introduced as follows. Obviously, the drawings in the following description are only some embodiments of the disclosure. For those of ordinary skill in the art, other drawings can also be obtained based on these drawings without making creative efforts.

Figure 1:
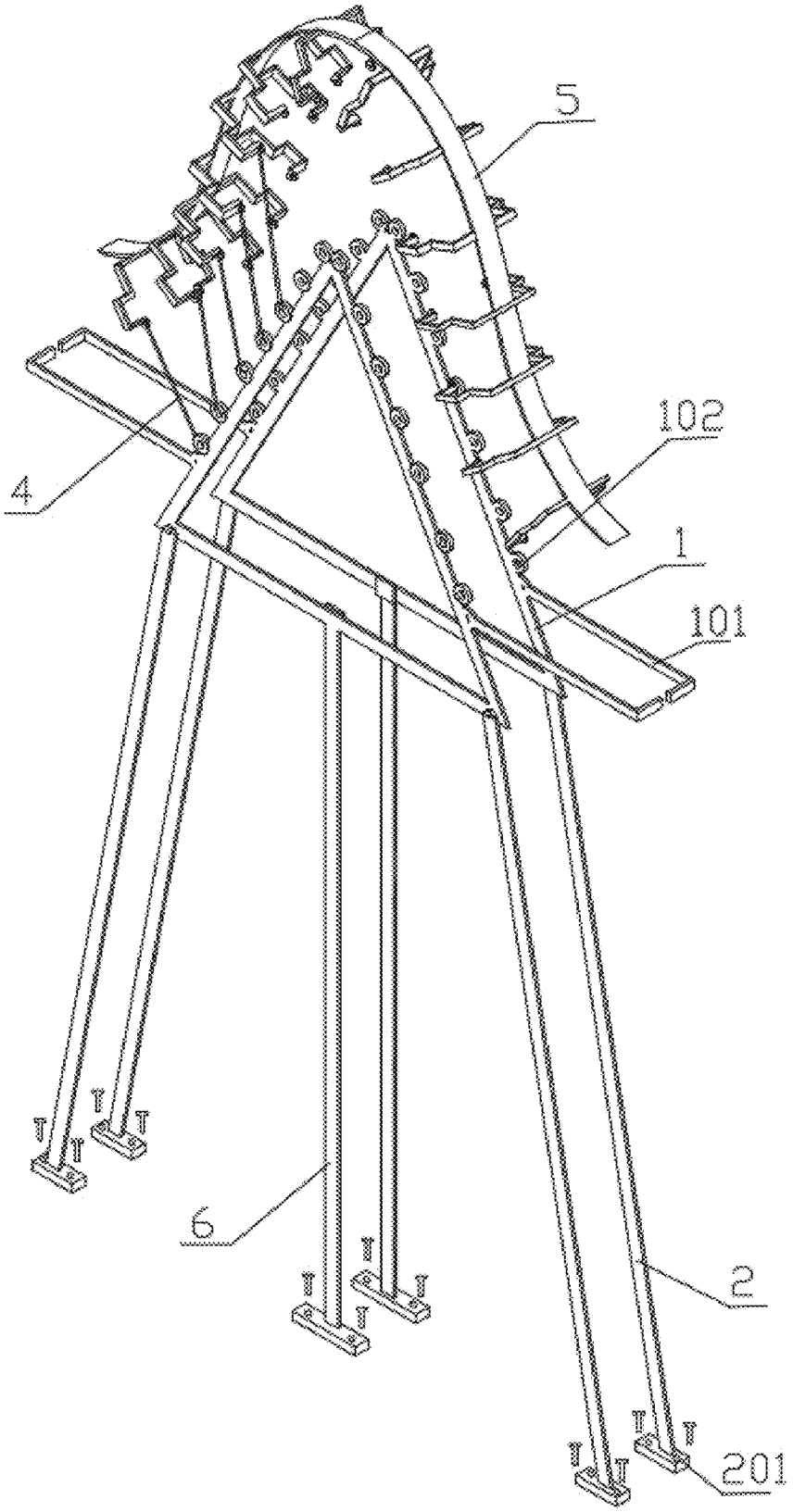
FIG. 1 is a schematic diagram illustrating a reinforcement device for correcting the alignment of a wok ear rammed earth wall.
Figure 2:
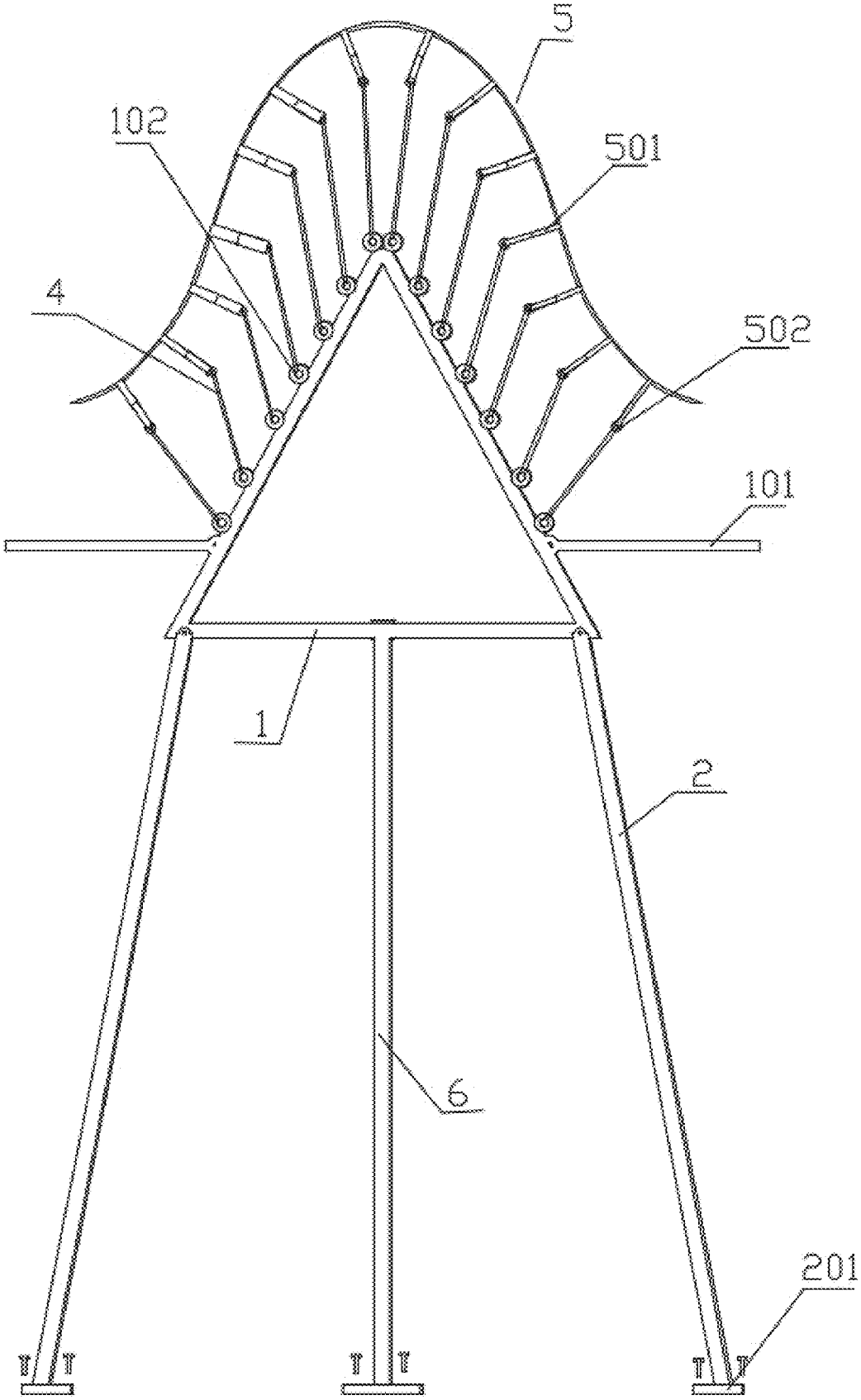
FIG. 2 is the main view of the structure of FIG. 1.
Figure 3:
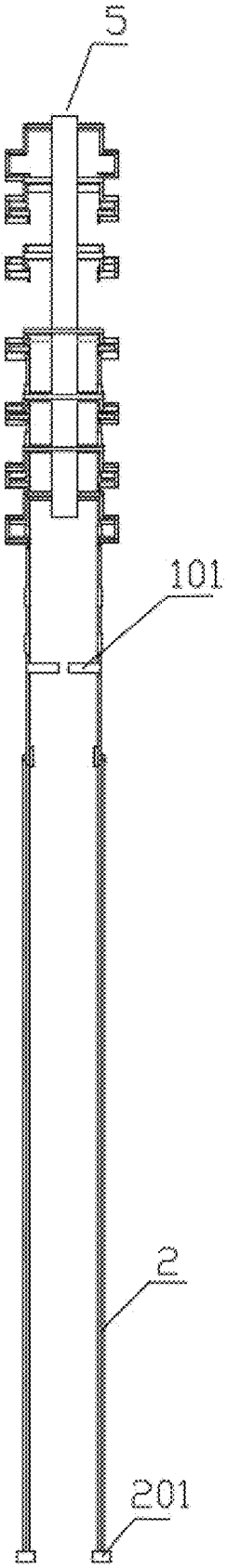
FIG. 3 is the left view of the structure of FIG. 1.

In the drawings, the parts represented by each number are listed as follows: 1—triangular fixing frame, 101—"L"-shaped connecting bar, 102—second connecting ring, 2—side leg support column, 201—support block, 3—rammed earth wall, 301—wok ear, 302—radial protrusion, 303—decorative protrusion, 4—rigid connecting plate, 5—strip-shaped fixing plate, 501—side fixing plate, 502—first connecting ring, 6—main support column.

DETAILED DESCRIPTION OF THE INVENTION

The technical solutions in the embodiments of the disclosure will be clearly and completely described below with reference to the accompanying drawings in the embodiments of the disclosure. Obviously, the described embodiments are only some of the embodiments of the disclosure rather than all the embodiments. Based on the embodiments of the disclosure, all other embodiments obtained by those of ordinary skill in the art without making creative efforts fall within the scope of protection of the disclosure.

In the description of the disclosure, it should be understood that the terms "upper surface", "both sides", "bottom", "end", "radial direction", etc. indicate orientation or positional relationship to only facilitate the description of the disclosure and simplified description rather than indicate or imply that the components or elements referred must be constructed and operated in a specific orientation. Therefore, these terms cannot be understood as limitations of the invention.

Figure 11:
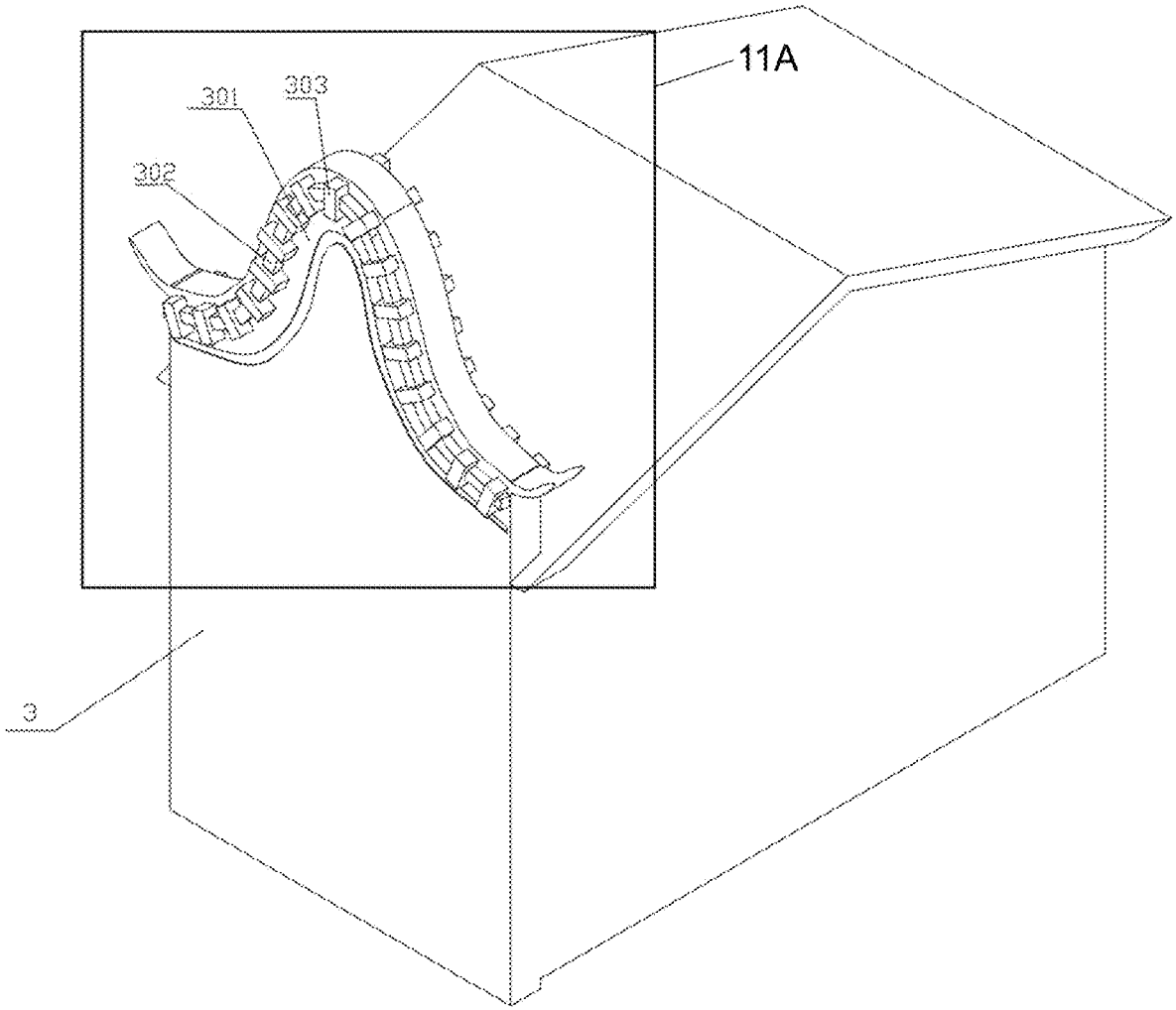
FIG. 11 is a schematic diagram illustrating the existing wok ear rammed earth wall without a reinforcement device of the technical solution.
Figure 11A:
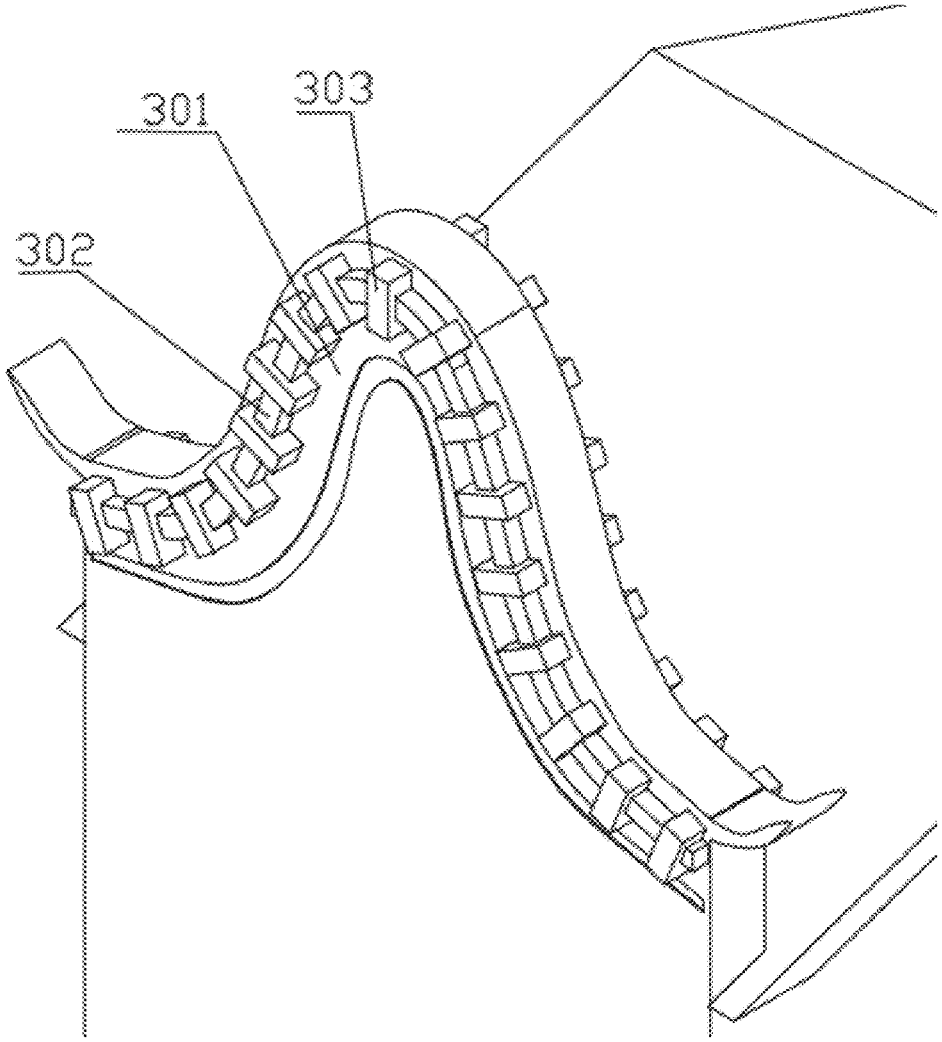
FIG. 11A is an enlarged view in area 11A in FIG. 11.
Figure 12:
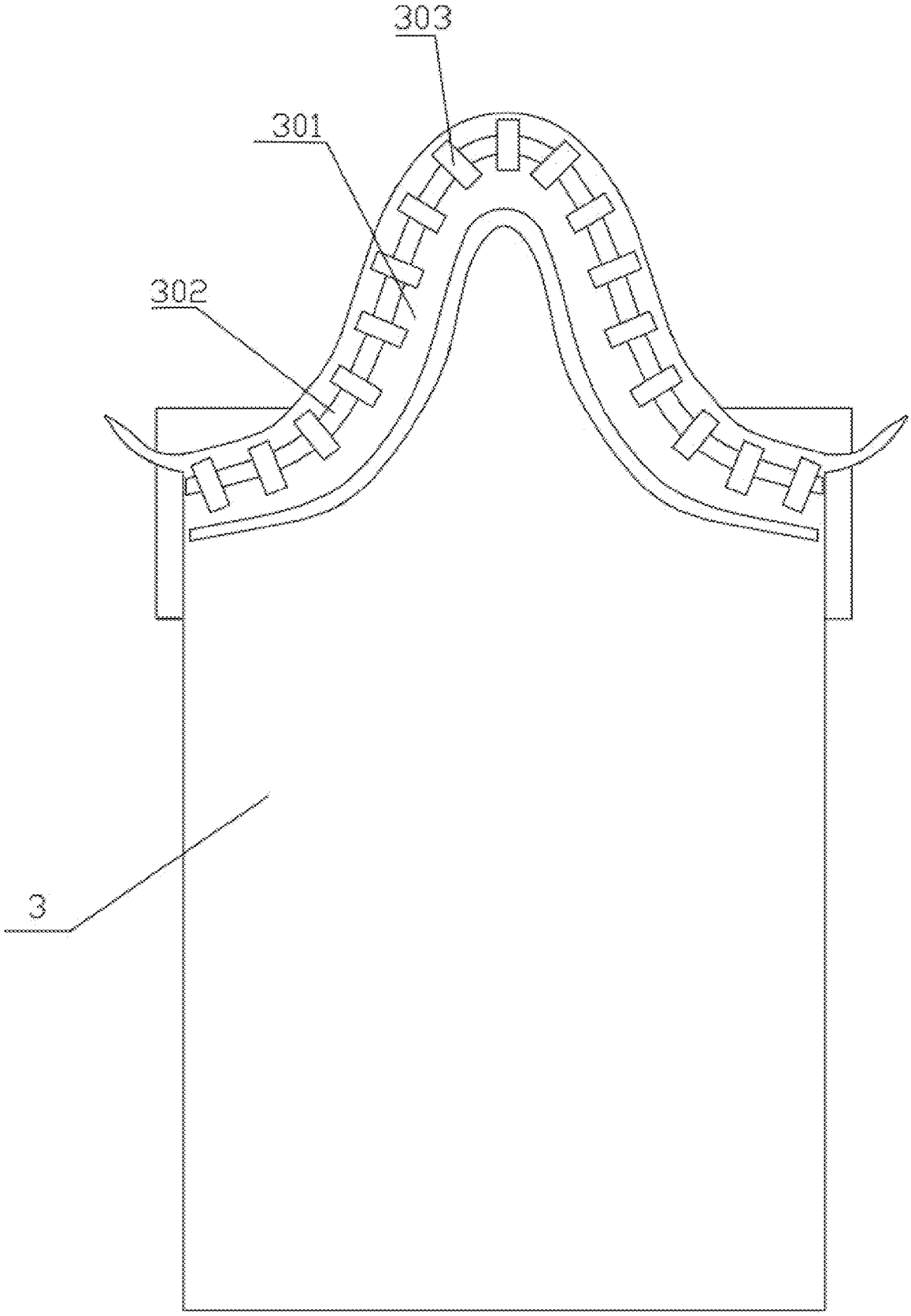
FIG. 12 is the main view of the structure of FIG. 11.

FIG. 11 and FIG. 12 are schematic diagrams illustrating the existing wok ear rammed earth wall without a reinforcement device. The wok ear rammed earth wall includes a wok ear 301 and a rammed earth wall 3. The rammed earth wall 3 is a wall structure located on both sides of the building house. The wok ear 301 is a structure arranged on the upper part of the rammed earth wall 3. In daily life, the bottom of the wok ear 301 connected to the rammed earth wall 3 is prone to deviation, tilt, or even fall. The main reason is that earthy materials are used such that the structural strength and stability are poor and the wok ear rammed earth wall is easy to be damaged.

Please refer to FIGS. 1-10. The disclosure provides a reinforcement device for correcting the alignment of a wok ear rammed earth wall, which includes:

A wok ear reinforcing structure includes a strip-shaped fixing plate 5 on the upper surface of a wok ear 301. The overall shape of the strip-shaped fixing plate 5 consists with the trending path of the wok ear 301 after being pressed down. 14 side fixing plates 501 are spaced apart on each of both sides of the strip-shaped fixing plate 5. An end of each of the side fixing plates 501 is provided with a first connecting ring 502. The 14 side fixing plates 501 are arranged on each of both sides of the strip-shaped fixing plate 5. The overall shape of the strip-shaped fixing plate 5 is similar to a "⎍" shape with a radian.

A rammed earth wall reinforcing structure includes triangular fixing frames 1 on both sides of the wok ear 301, two side leg support columns 2 on the bottom of each of the triangular fixing frames 1, and a main support column 6 between the two side leg support columns 2. The triangular fixing frames 1 on both sides of the wok ear 301 respectively extend to form "L"-shaped connecting bars 101 symmetric to each other. The ends of the "L"-shaped connecting bars 101 are correspondingly welded together to form a surrounding integral structure. The two waist sides of the triangular fixing frame 1 are provided with second connecting rings 102 spaced apart to correspond to the first connecting rings 502. The number of the second connecting rings 102 is equal to that of the first connecting rings 502.

The second connecting rings 102 and the first connecting rings 502 are welded d by rigid connecting plates 4.

The strip-shaped fixing plate 5 and the side fixing plates 501 are arranged within grooves formed on the surface of the wok ear 301. The side fixing plates 501 are located on both sides of the wok ear 301 and are arranged within gaps between adjacent pairs of decorative protrusions 303 on radial protrusions 302. At least one of the side fixing plates 501 is arranged between adjacent two of the decorative protrusions 303.

Figure 4:
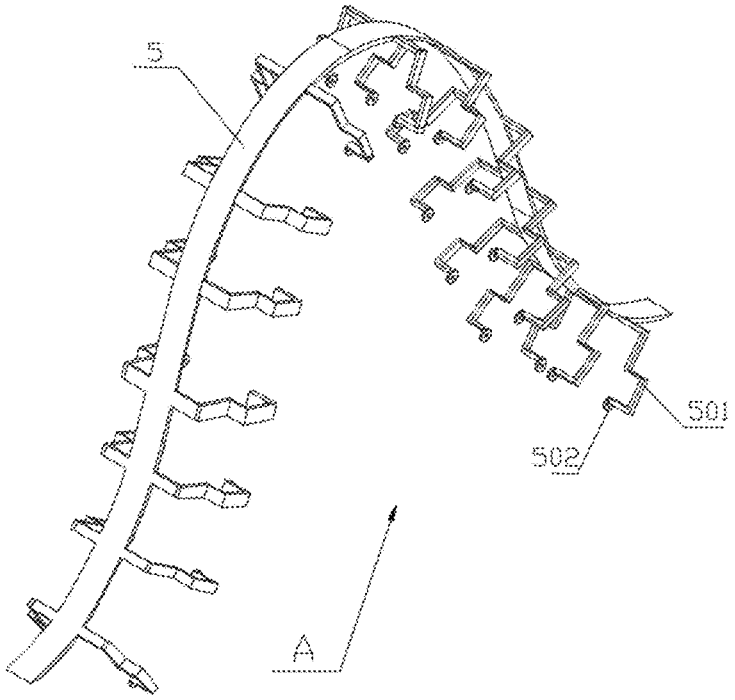
FIG. 4 is a schematic diagram illustrating a wok ear reinforcing structure.
Figure 5:
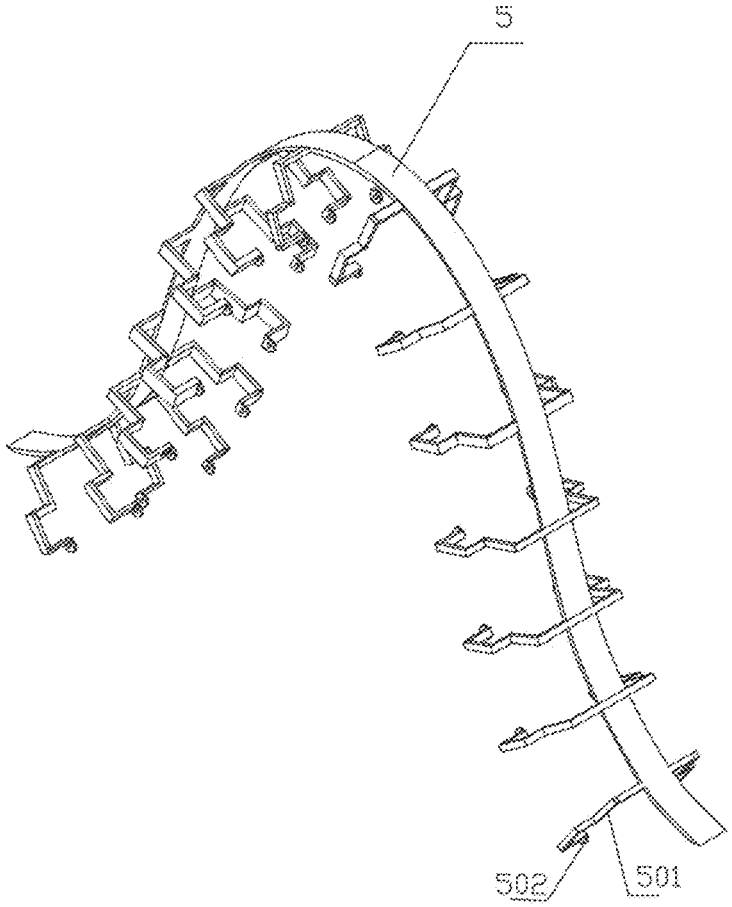
FIG. 5 is a schematic diagram illustrating the structure from perspective A in FIG. 4.
Figure 6:
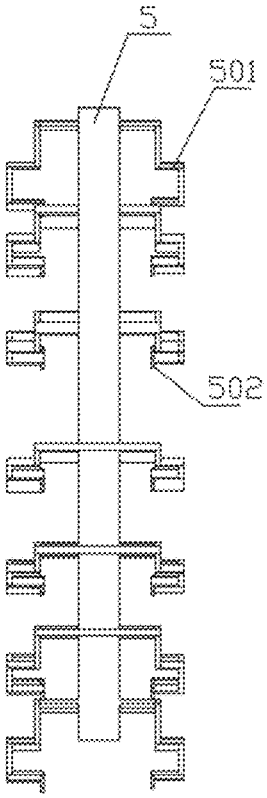
FIG. 6 is the left view of the structure of FIG. 4.
Figure 7:
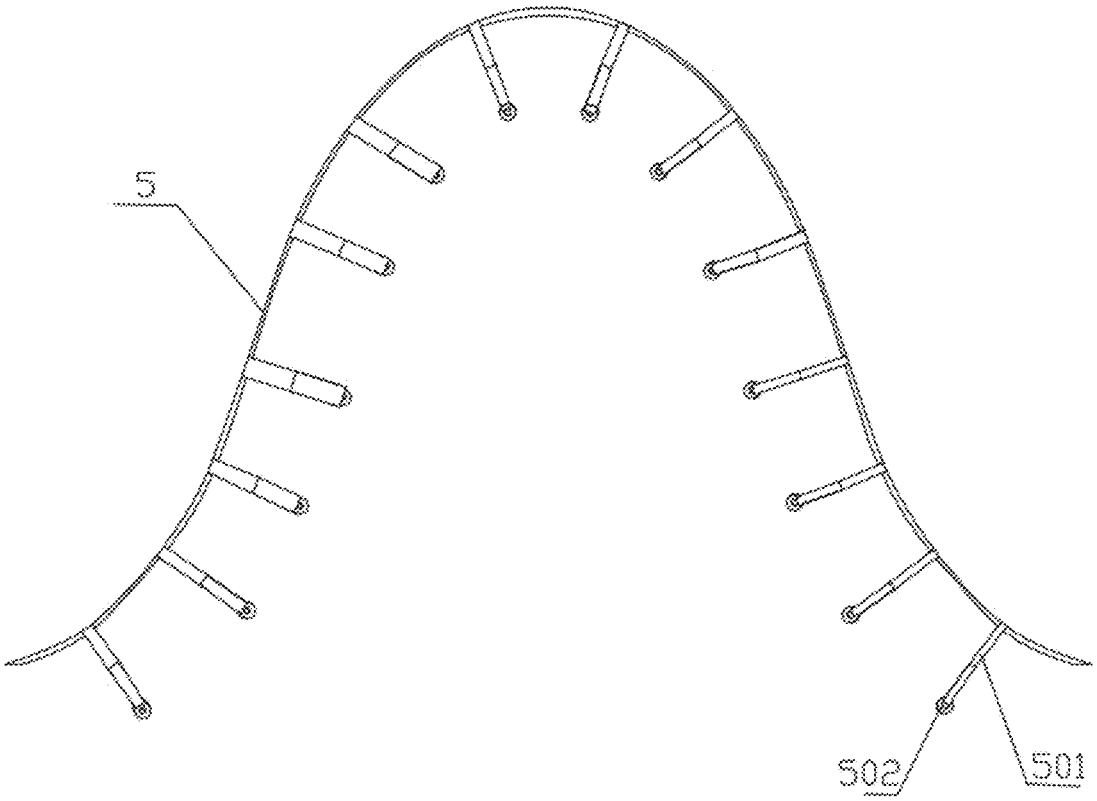
FIG. 7 is the main view of the structure of FIG. 4.
Figure 8:
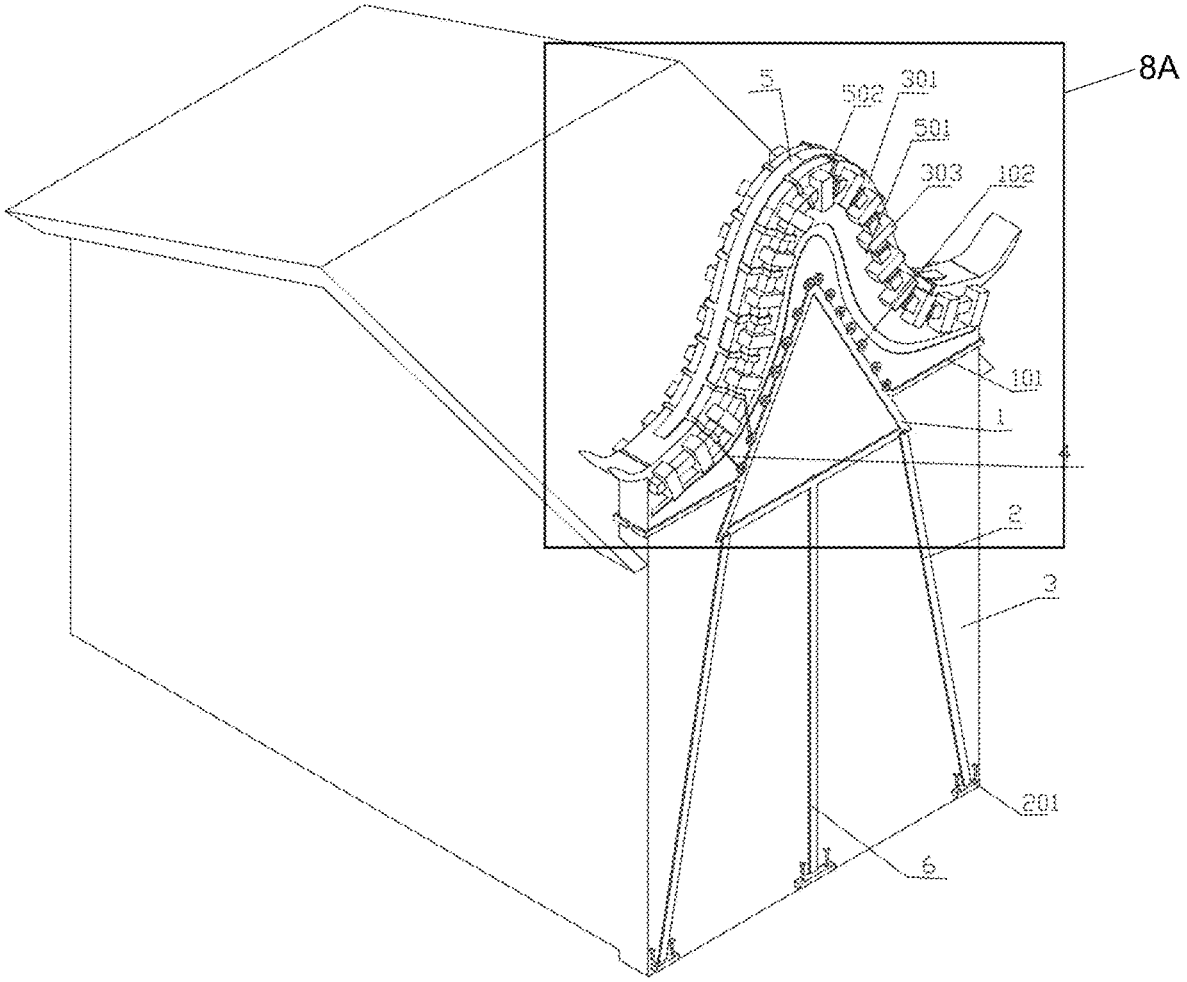
FIG. 8 is a schematic diagram illustrating a reinforcement device combined with a wok ear rammed earth wall of the technical solution.
Figure 8A:
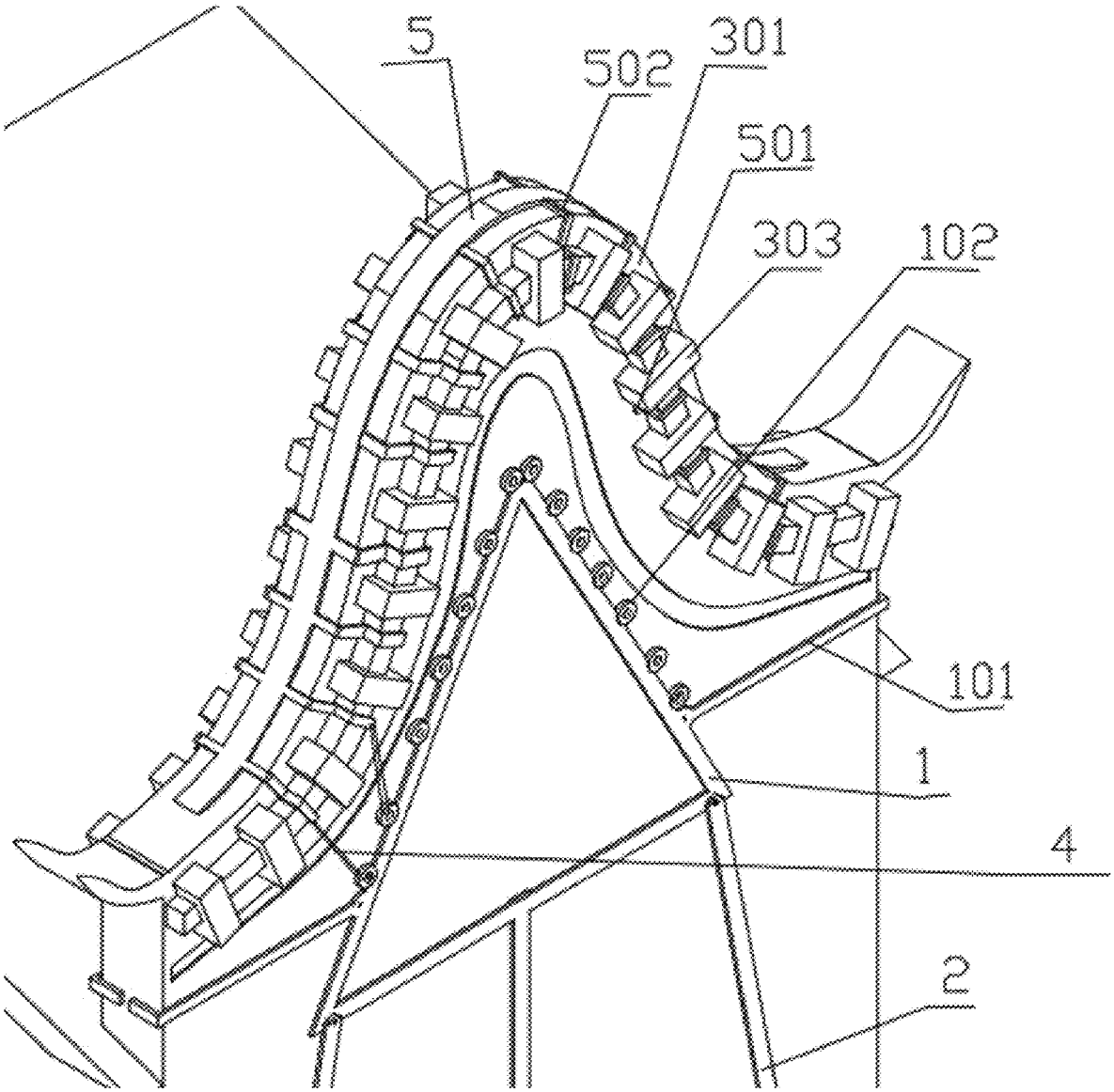
FIG. 8A is an enlarged view in area 8A in FIG. 8.
Figure 9:
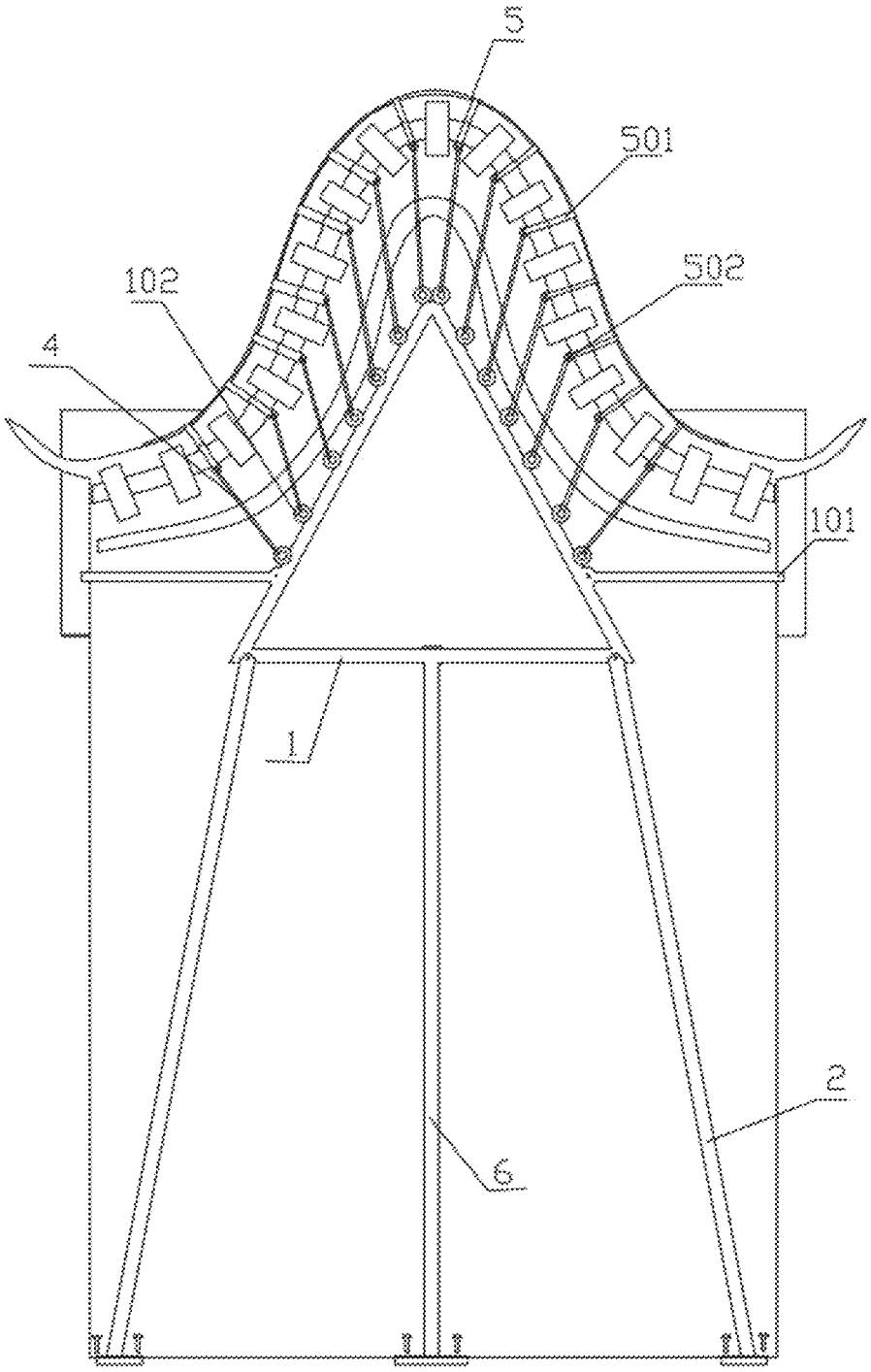
FIG. 9 is the main view of the structure of FIG. 8.
Figure 10:
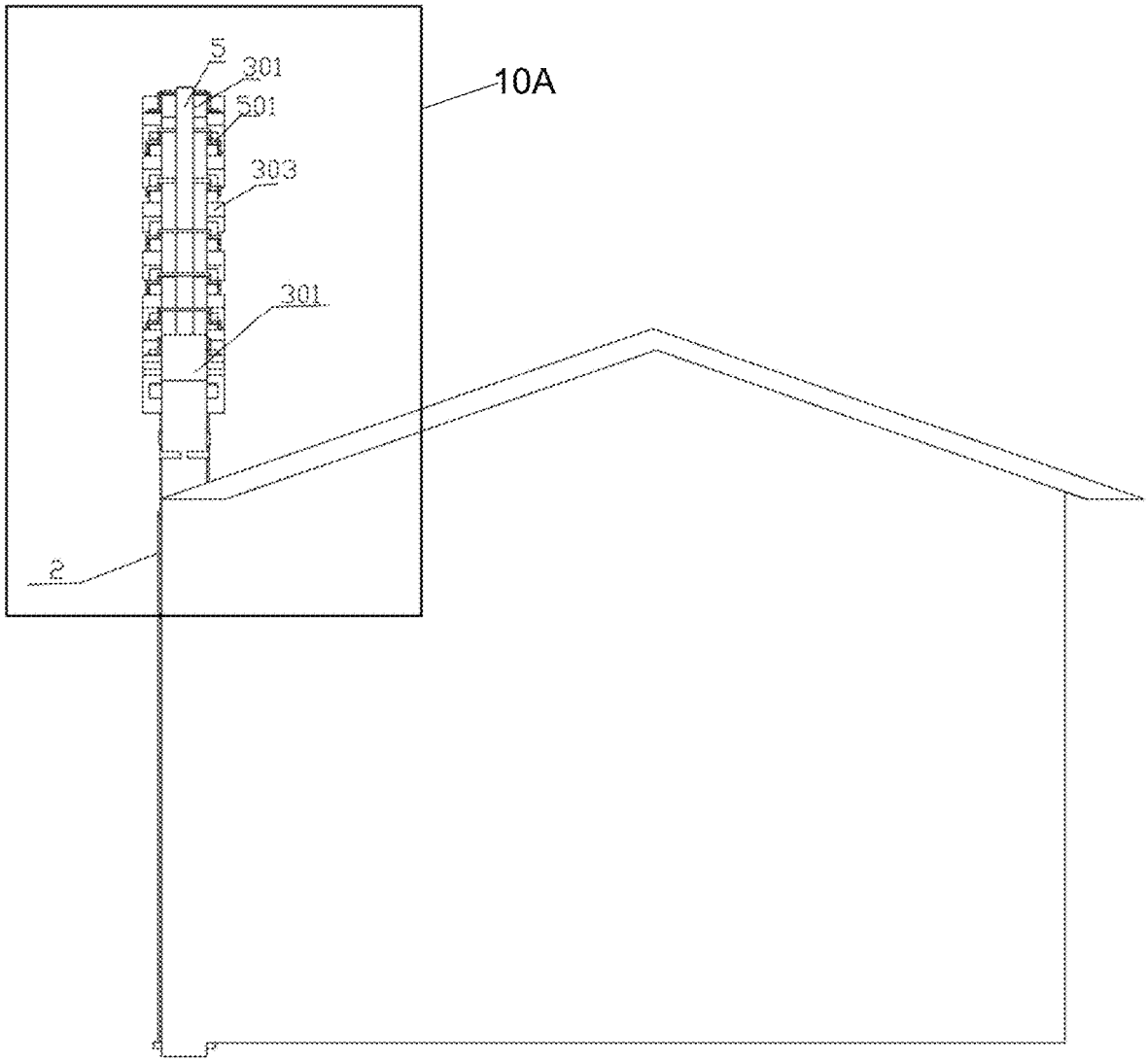
FIG. 10 is the right view of the structure of FIG. 4.
Figure 10A:
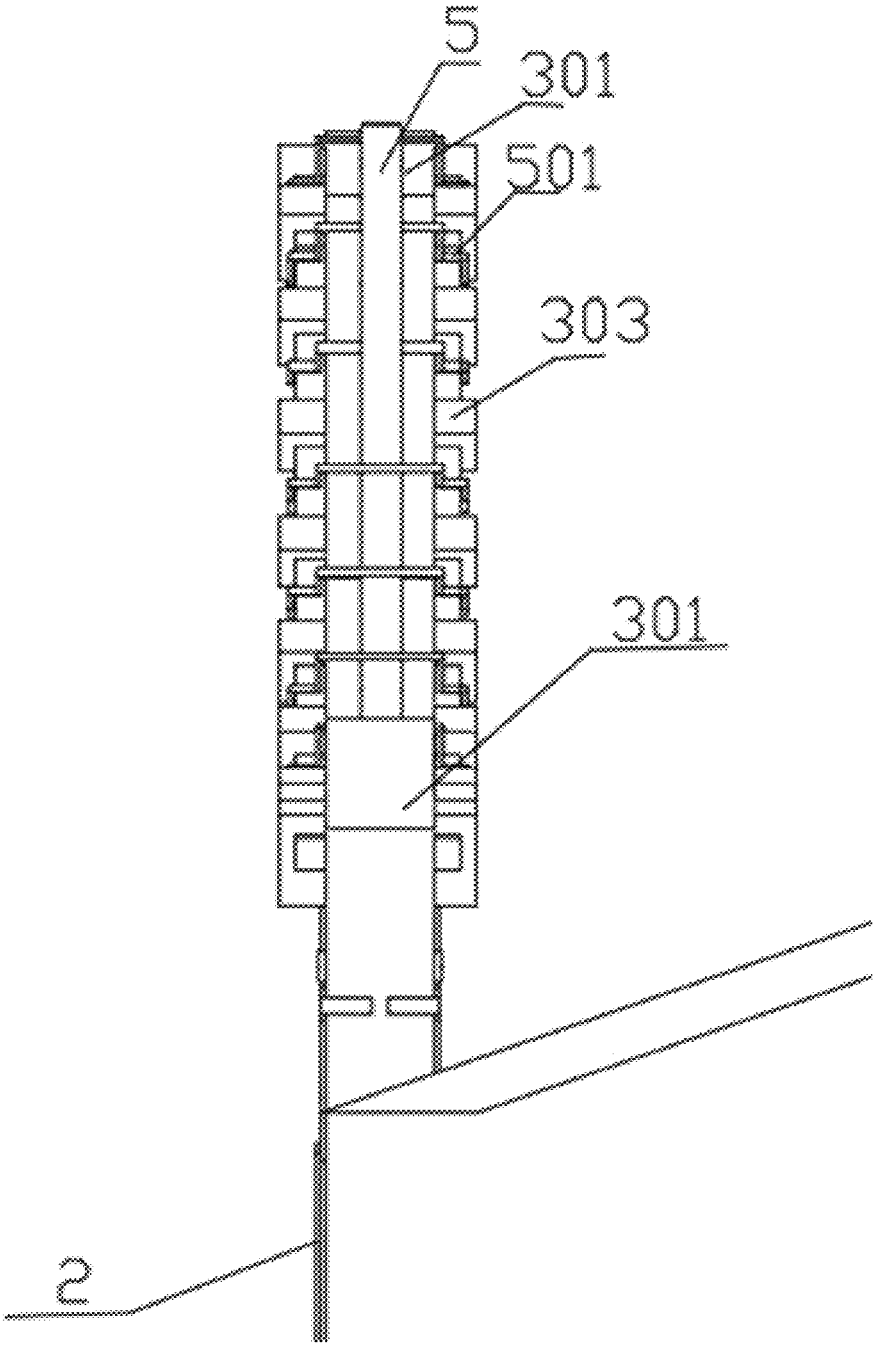
FIG. 10A is an enlarged view in area 10A in FIG. 10.

Wherein, the side fixing plate 501 has a semi-convex shape that consists with the outer contour of the radial protrusion 302, as illustrated in FIG. 4 and FIG. 5.

Wherein, the strip-shaped fixing plate 5 and the side fixing plates 501 are rigid fixing plates and their thickness is consistent with the depth of the grooves formed on the wok ear 301. The strip-shaped fixing plate 5, the side fixing plate 501, and the "L"-shaped connecting bar 101 are all made of stainless steel with a thickness of 3 mm.

Wherein, the triangular fixing frames 1, the "L"-shaped connecting bars 101, the side leg support columns 2, and the main support column 6 are all snugly fitted against the surface of the rammed earth wall 3 and are arranged within the grooves formed on the outer surface of the rammed earth wall 3. The thickness of each of the triangular fixing frame 1, the "L"-shaped connecting bar 101, the side leg support column 2, and the main support column 6 is equal to the depth of the corresponding groove. The triangular fixing frame 1, the "L"-shaped connecting bar 101, the side leg support columns 2, and the main support column 6 are all implemented with stainless steel square tubes.

Wherein, the bottom of each of the side leg support column 2 and the main support column 6 is provided with a support block 201 and the surface of the support block 201 is provided with a bolt hole fixed with a grounding bolt.

Wherein, the grooves formed the outer surfaces of both the wok ear and the rammed earth wall are filled and coated with glutinous rice and mortar to form a mud layer. The material and color of the mud layer respectively match the material and color of the surface of the wok ear rammed earth wall.

The installation method of the disclosure is described as follows:

According to the shape and size of the top wok ear 301 of the rammed earth wall that need to be reinforced, a strip-shaped fixing plate 5 is customized, wherein the trending path of the strip-shaped fixing plate 5 consists with the trending path of the wok ear. The fixing plates 501 are arranged on both sides of the strip-shaped fixing plate 5 according to the positional relationship of the decorative protrusions 303. Then, two triangular fixing frames 1 are customized according to the area and size of the top wok ear 301. The side leg support columns 2 and main support columns 6 are customized according to the height of the rammed earth wall 3. Then, the scaffolding is built on site and the top wok ear 301 is corrected to form grooves on the surface and install the top wok ear 301. Then, the two triangular fixed frames 1, the side leg support columns 2 and the main support column 6 are installed. The rigid connecting plates 4 and the "L"-shaped connecting bars are welded to each other to form an integral fixed structure. Finally, the bottoms of the side leg support columns 2 and the main support column 6 are fastened to the ground with bolts to achieve an overall fixed connection, thereby ensuring the stability and structural strength of the rammed earth wall.

The disclosure has the following beneficial effects:

1. The disclosure provides a wok ear reinforcing structure and a rammed earth wall reinforcing structure. The wok ear reinforcing structure is composed of a strip-shaped fixing plate and side fixing plates on both sides of the strip-shaped fixing plate. The rammed earth wall reinforcing structure is composed of triangular fixing frames, "L"-shaped connecting bars on both sides of the triangular fixing frame, a main support column, and side leg support columns. The structure is implemented with an assembled structure, which can be designed and customized separately based on the shapes and sizes of different wok ear rammed earth walls and assembled on site. It has the advantages of convenient transportation and simple use and installation.
2. The structure of the disclosure forms grooves on the surface of the wok ear rammed earth wall and pre-embeds components into the grooves to fix and install the overall frame. After the installation is completed, the grooves formed on outer surfaces of both the wok ear and the rammed earth wall are filled and coated with glutinous rice and mortar to form a mud layer. The material and color of the mud layer respectively match the material and color of the surface of a wok ear rammed earth wall, thereby ensuring the original appearance of the wok ear rammed earth wall. The structure of the disclosure is less destructive and greatly used to enhance the structural strength.
3. The structure of the disclosure is exquisitely designed. It can correct and protect the wok ear structure and place it tilted, such that the wok ear and the rammed earth wall are integrally formed and the overall building structure is fixed with the ground to form one, thereby ensuring the strength of the structure and greatly improving the stability and anti-falling ability of the building structure.

The preferred embodiments of the disclosure disclosed above are only intended to help describe the invention. The preferred embodiments do not describe all details and limit the specific implementations of the disclosure. Obviously, many modifications and variations are possible in the specification. These embodiments are selected and described in detail in this specification to better explain the principles and practical applications of the disclosure, so that those skilled in the art can better understand and utilize the disclosure. The invention is limited only by the claims and equivalents.

What is claimed is:

1. A reinforcement device for correcting the alignment of a wok ear rammed earth wall comprising:

a wok ear reinforcing structure comprising a strip-shaped fixing plate on an upper surface of a wok ear, an overall shape of the strip-shaped fixing plate consists with a trending path of the wok ear after being pressed down, several side fixing plates are spaced apart on each of both sides of the strip-shaped fixing plate, a first end of each of the side fixing plates is fixed on the strip-shaped fixing plate and a second end of each of the side fixing plates is provided with a first connecting ring; and a rammed earth wall reinforcing structure comprising triangular fixing frames on both sides of the wok ear, two side leg support columns on a bottom of each of the triangular fixing frames, and a main support column between the two side leg support columns, the triangular fixing frames on both sides of the wok ear respectively extend to form "L"-shaped connecting bars symmetric to each other, ends of the "L"-shaped connecting bars are correspondingly welded together to form a surrounding integral structure, the triangular fixing frame having two waist sides are provided with second connecting rings spaced apart to correspond to the first connecting rings, number of the second connecting rings is equal to that of the first connecting rings, and the second connecting rings and the first connecting rings are welded by rigid connecting plates; wherein, the wok ear and radial protrusions define a top portion of the wok ear rammed earth wall, the top portion is substantially boater-hat-shaped, the wok ear is a crown of top portion, the radial protrusions on left and right sides of the wok ear form a brim of top portion, each of the side fixing plates is bent three times to form two steps and then bent inward, an upper one of the two steps is configured to the clamp the wok ear and a lower one of the two steps is configured to the clamp radial protrusions;

the wok ear reinforcing structure is connected and fixed with the triangular fixing frame through connecting the first connecting rings with the second connecting rings in order to clamp and shape the boater-hat-shaped top portion, the strip-shaped fixing plate is arch-shaped with a vertex at a top and two sides forming an opening facing downward, each of the two sides is s-shaped with upper portion convex outward and lower portion concaved inward and the two sides are symmetrical to each other about a vertical axis, the wok ear reinforcing structure and the triangular fixing frame is symmetrical relative to a center line of the wok ear rammed earth wall, a top point of the wok ear reinforcing structure and a top point of the triangular fixing frame are aligned on the center line of the wok ear rammed earth wall, and connecting the wok ear reinforcing structure with the rammed earth wall reinforcing structure is configured to correct a shape and structure of the wok ear rammed earth wall.

2. The reinforcement device for correcting the alignment of a wok ear rammed earth wall according to claim 1, wherein the strip-shaped fixing plate and the side fixing plates are arranged within grooves formed on a surface of the wok ear, the side fixing plates are located on both sides of the wok ear and are arranged within gaps between adjacent pairs of decorative protrusions on the radial protrusions, and at least one of the side fixing plates is arranged between adjacent two of the decorative protrusions.

3. The reinforcement device for correcting the alignment of a wok ear rammed earth wall according to claim 2, wherein the side fixing plate has a semi-convex shape that consists with an outer contour of the radial protrusion.

4. The reinforcement device for correcting the alignment of a wok ear rammed earth wall according to claim 2, wherein the strip-shaped fixing plate and the side fixing plates are rigid fixing plates and their thickness is consistent with a depth of the grooves formed on the wok ear.

5. The reinforcement device for correcting the alignment of a wok ear rammed earth wall according to claim 1, wherein the triangular fixing frames, the "L"-shaped connecting bars, the side leg support columns, and the main support column are all snugly fitted against a surface of a rammed earth wall and are arranged within grooves formed on an outer surface of the rammed earth wall, and a thickness of each of the triangular fixing frame, the "L"-shaped connecting bar, the side leg support column, and the main support column is equal to a depth of the at least one groove.

6. The reinforcement device for correcting the alignment of a wok ear rammed earth wall according to claim 5, wherein a bottom of each of the side leg support column and the main support column is provided with a support block and a surface of the support block is provided with a bolt hole fixed with a grounding bolt.

7. The reinforcement device for correcting the alignment of a wok ear rammed earth wall according to claim 1, wherein grooves formed on outer surfaces of both the wok ear and the rammed earth wall are filled and coated with glutinous rice and mortar to form a mud layer and material and color of the mud layer respectively match material and color of a surface of a wok ear rammed earth wall.

* * * * *